US008418951B2

(12) United States Patent
Ruggenenti

(10) Patent No.: US 8,418,951 B2
(45) Date of Patent: Apr. 16, 2013

(54) SPOOL FOR WINDING METALLIC WIRE

(75) Inventor: Luca Ruggenenti, Remedello (IT)

(73) Assignee: Sodetal SAS, Tronville-en-Barrois (FR)

( * ) Notice: Subject to any disclaimer, the term of this patent is extended or adjusted under 35 U.S.C. 154(b) by 250 days.

(21) Appl. No.: 12/867,557

(22) PCT Filed: Feb. 5, 2009

(86) PCT No.: PCT/EP2009/051300

§ 371 (c)(1),
(2), (4) Date: Aug. 13, 2010

(87) PCT Pub. No.: WO2009/101019

PCT Pub. Date: Aug. 20, 2009

(65) Prior Publication Data

US 2010/0327103 A1 Dec. 30, 2010

(30) Foreign Application Priority Data

Feb. 14, 2008 (IT) ..... MN20080002 U

(51) Int. Cl.
*B65H 75/14* (2006.01)
*B65H 75/30* (2006.01)

(52) U.S. Cl.
USPC ..... 242/608.8; 242/611.1; 242/614; 242/118.6

(58) Field of Classification Search ..... 242/600, 242/607, 608, 608.8, 611, 611.1, 614, 614.1, 242/118, 118.4, 118.6
See application file for complete search history.

(56) References Cited

U.S. PATENT DOCUMENTS

| | | | |
|---|---|---|---|
| 2,150,392 | A | 3/1939 | Mossberg et al. |
| 2,212,377 | A | 8/1940 | Olson et al. |
| 2,636,695 | A | 4/1953 | Bixby |
| 2,662,701 | A | 12/1953 | Weber |
| 3,542,308 | A | 11/1970 | Starratt |

FOREIGN PATENT DOCUMENTS

| | | |
|---|---|---|
| GB | 652954 | 5/1951 |
| JP | 59-143516 U | 9/1978 |
| JP | 2005-96886 | 4/2005 |
| JP | 2007-230688 A | 9/2007 |
| WO | WO 2008/128925 A1 | 10/2008 |

OTHER PUBLICATIONS

Machine Translation of JP 2005-96886 A.*
International Search Report dated Apr. 28, 2009.
Japanese Office Action issued in Application No. 2010-546290 on Oct. 16, 2012 with English language translation.

* cited by examiner

*Primary Examiner* — William E Dondero
(74) *Attorney, Agent, or Firm* — Scully, Scott, Murphy & Presser, P.C.

(57) ABSTRACT

A spool for winding metallic wire, comprising a tubular body for supporting the coil of wire that is provided, at ends thereof, with wall elements, each wall element comprising a flat flange with a stiffening fold at the outer edge, jointly connected by welding to the corresponding end of the tubular body, and a flat complementary flange, seamed by spot welding to the outer surface of the flange, at least one pawl being jointly connected to the complementary flange of at least one wall element.

4 Claims, 2 Drawing Sheets

SPOOL FOR WINDING METALLIC WIRE

TECHNICAL FIELD

The present invention relates to a spool for winding metallic wire.

BACKGROUND ART

It is known that spools for winding metallic wire, which comprise a tubular body for supporting the coil of wire that is provided, at its ends, with wall elements for containing the coil, are widely used in the industrial field.

Known spools suffer some drawbacks.

DISCLOSURE OF THE INVENTION

Therefore the aim of the present invention is to provide a spool that has maximum constructive simplicity and considerable stiffening characteristics.

This aim, this and other objects which will become better apparent hereinafter, are achieved by a spool for winding metallic wire, according to the present invention, comprising a tubular body for supporting a coil of wire that is provided, at ends thereof, with wall elements for containing said coil, at least one of which is provided, at a surface directed outward, with at least one pawl for engagement with means for turning said spool, characterized in that each wall element comprises a flat flange with a stiffening fold out at the outer edge, which is jointly connected by welding to the corresponding end of the tubular body, and a flat complementary flange, which is seamed by spot welding to the outer surface of said flange, at least one pawl being jointly connected to said complementary flange of at least one wall element.

BRIEF DESCRIPTION OF THE DRAWINGS

Further characteristics and advantages of the spool according to the present invention will become better apparent from the description of a preferred but not exclusive embodiment thereof, illustrated by way of non-limiting example in the accompanying drawings, wherein.

WAYS OF CARRYING OUT THE INVENTION

Figure 1:
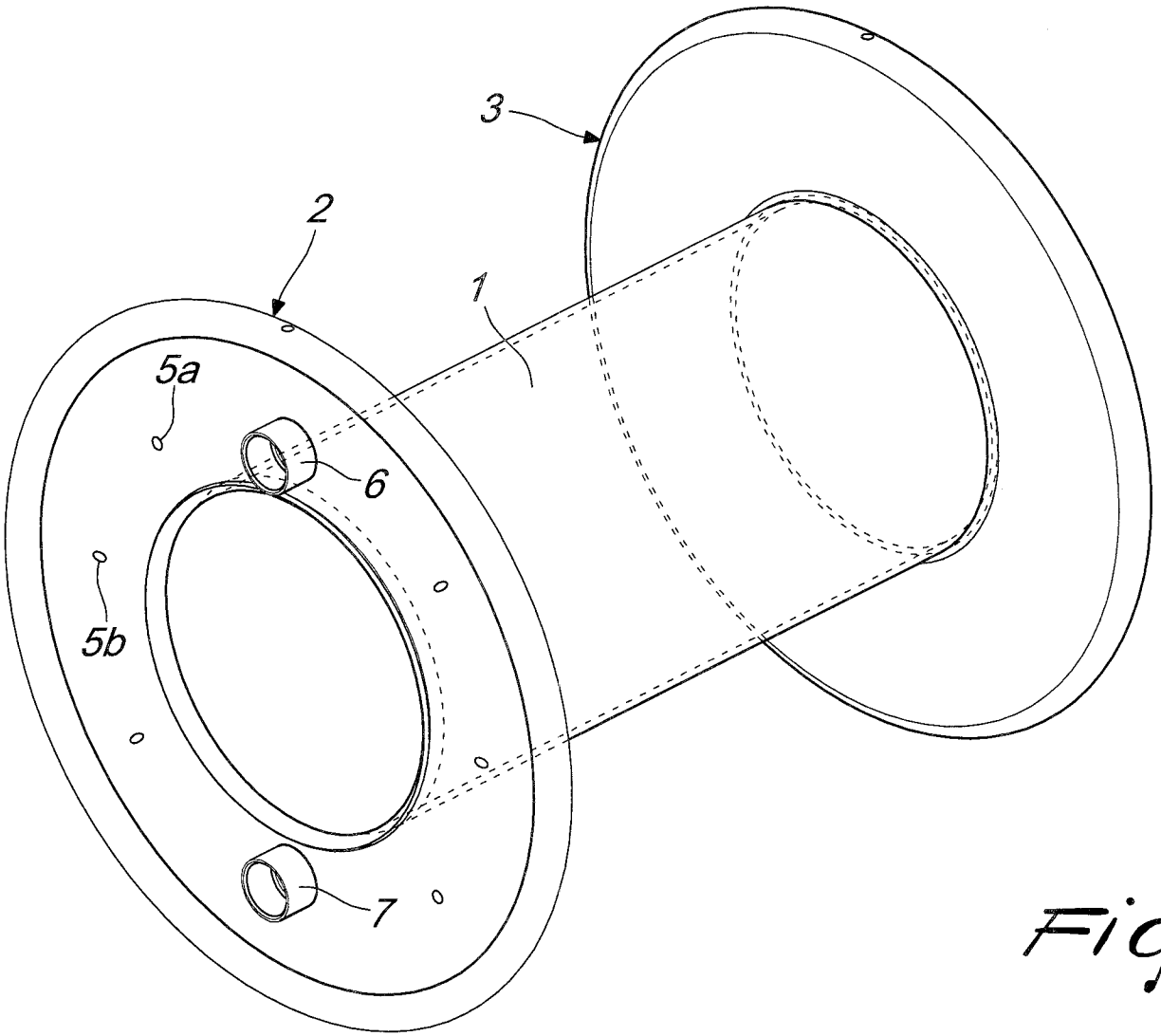
FIG. 1 is a perspective view of the spool, according to the invention.

With reference to the figures, reference numeral 1 designates a tubular body for supporting a coil of wire that is provided, at its ends, with two wall elements 2 and 3, which are mirror-symmetrically identical.

Therefore, only the element 2 is described. It comprises a flat flange 4, with a stiffening fold 4*a* at the outer edge, jointly connected by welding 4*b* to the corresponding end of the tubular body 1.

A flat complementary flange 5 is seamed to the flange 4 at the outer surface of the flange by means of spot welds 5*a*, 5*b* and is provided with at least one and preferably two jointly connected pawls 6 and 7 which are associated with the complementary flange by welding at an inner edge 6*a* for the pawl 6; as regards such pawls, it should be noted that they might be is absent in the wall element 3.

The pawls are adapted for engagement with means for turning the spool.

Figure 2:
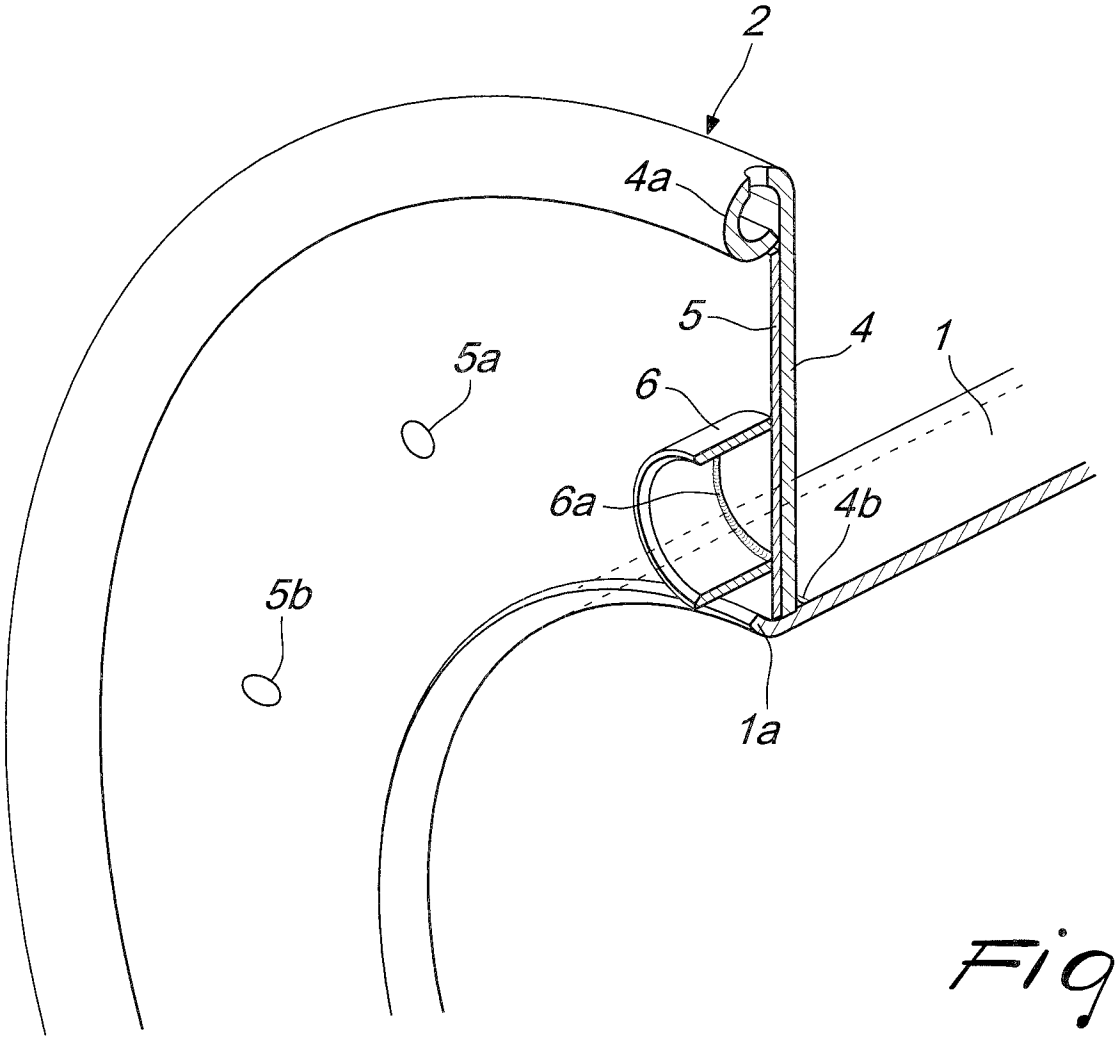
FIG. 2 is a view of a detail of FIG. 1.

Finally, the two ends of the tubular body 1 have the wall shaped like a bevel 1*a* for the end that can be seen in FIG. 2; such bevel allows convenient ways of approaching the spindle designed to support the spool during operation.

From what has been described it is readily evident that the spool according to the invention lends itself to be provided according to very simple manufacturing methods, and it is also noted that it has stiffness characteristics that ensure maximum correctness in operation.

In the practical embodiment of the invention, all the details may be replaced with other technically equivalent elements.

The disclosures in Italian Utility Model Application No. MN2008U0000002 from which this application claims priority are incorporated herein by reference.

The invention claimed is:

1. A spool for winding metallic wire, comprising:

a tubular body for supporting a coil of wire between opposite ends of said tubular body, said tubular body comprising a wall shaped at each of said opposite ends to form respective bevels that allow conveniently approaching a spindle configured to support the spool during operation;

wall elements provided at said opposite ends of said tubular body for containing said coil, wherein said respective bevels extend outwardly from said wall elements; and at least one pawl configured to engage means for turning the spool, said at least one pawl being provided at a surface of at least one of said wall elements directed away from said tubular body;

wherein said wall elements each comprise:

a flat flange comprising a stiffening fold provided at an outer edge of said flat flange, said flat flange being jointly connected by welding to a corresponding one of said opposite ends of said tubular body; and a flat complementary flange, which is seamed by spot welding to an outer surface of said flat flange directed away from said tubular body, said at least one pawl being jointly connected to said complementary flange at an outer surface of said complementary flange that is directed away from said flat flange.

2. The spool of claim 1, wherein said at least one pawl is jointly connected to the corresponding complementary flange by welding at an inner edge thereof.

3. A spool for winding metallic wire, comprising:

a tubular body for supporting a coil of wire between opposite ends of said tubular body, said opposite ends of the tubular body each comprising a wall shaped to form a bevel with a flared rim, said bevel being shaped to allow conveniently approaching the spindle configured to support the spool during operation;

wall elements provided at said opposite ends of said tubular body for containing said coil, wherein said bevels extend outwardly from said wall elements; and at least one pawl configured to engage means for turning the spool, said at least one pawl being provided at a surface of at least one of said wall elements that is directed away from said tubular body;

wherein said wall elements each comprise:

a flat flange comprising a stiffening fold at an outer edge of the flat flange, said flat flange being jointly connected by welding to a corresponding one of said opposite ends of said tubular body; and a flat complementary flange, which is seamed by spot welding to an outer surface of said flat flange directed away from said tubular body, said at least one pawl being jointly connected to said complementary flange at an outer surface of said complementary flange directed away from said flat flange.

4. A spool for winding metallic wire, comprising:

a tubular body for supporting a coil of wire between opposite ends of said tubular body, said opposite ends of the tubular body each comprising a wall shaped to form a bevel with a flared rim, said bevel being shaped to allow conveniently approaching the spindle configured to support the spool during operation;

wall elements provided at said opposite ends of said tubular body for containing said coil; and at least one pawl configured to engage means for turning the spool that is provided at a surface of at least one of said wall elements directed away from said tubular body;

wherein said wall elements each comprise:

a flat flange comprising a stiffening fold at an outer edge of the flat flange, said flat flange being jointly connected by welding to a corresponding one of said opposite ends of said tubular body; and a flat complementary flange, which is seamed by spot welding to an outer surface of said flat flange directed away from said tubular body, said at least one pawl being jointly connected to said complementary flange at an outer surface of said complementary flange directed away from said flat flange;

and wherein:

said tubular body is inserted, at said opposite ends thereof, into central openings of both said flat flange and said flat complementary flange; and said flared rim has an outer diameter that is greater than an inner diameter of the central openings of both said flat flange and said flat complementary flange and protrudes beyond said outer surface of said flat complementary flange.

* * * * *